United States Patent [19]

Poritz

[11] 4,241,526

[45] Dec. 30, 1980

[54] PERPETUAL CALENDAR

[76] Inventor: Nathan Poritz, 90 Greenwich Ave., New York, N.Y. 10001

[21] Appl. No.: 95,617

[22] Filed: Nov. 19, 1979

[51] Int. Cl.[3] ..... G09D 3/00

[52] U.S. Cl. ..... 40/110

[58] Field of Search ..... 40/110, 107, 109

[56] References Cited

U.S. PATENT DOCUMENTS

| | | | |
|---|---|---|---|
| 1,007,760 | 11/1911 | Williams | 40/110 |
| 1,190,967 | 7/1916 | Stacy | 40/110 |
| 1,524,164 | 1/1925 | Bennet | 40/110 |

FOREIGN PATENT DOCUMENTS

| | | | |
|---|---|---|---|
| 818338 | 10/1951 | Fed. Rep. of Germany | 40/110 |
| 189428 | 5/1937 | Switzerland | 40/110 |
| 17273 | of 1900 | United Kingdom | 40/110 |
| 247119 | 2/1926 | United Kingdom | 40/110 |

*Primary Examiner*—John F. Pitrelli
*Attorney, Agent, or Firm*—Natter & Natter

[57] ABSTRACT

A perpetual calendar in kit form which includes a visual display board for accepting grid sheets having an array of spaces corresponding to the days in a month. The current month is designated on the board by a positioning peg. The days of the week are denoted on tabs which are slidably positionable on the board for monthly orientation with the grid sheet. A writing instrument is suspended from the board in overlying position with respect to the grid sheet and is placed under a selected weekday for aligning monthly dates occurring on that day. The writing instrument also includes an adjustably displaceable date index which can be keyed to any date on the grid sheet. In addition, the writing instrument is further removable for recording information on the grid sheet.

10 Claims, 6 Drawing Figures

FIG. 1
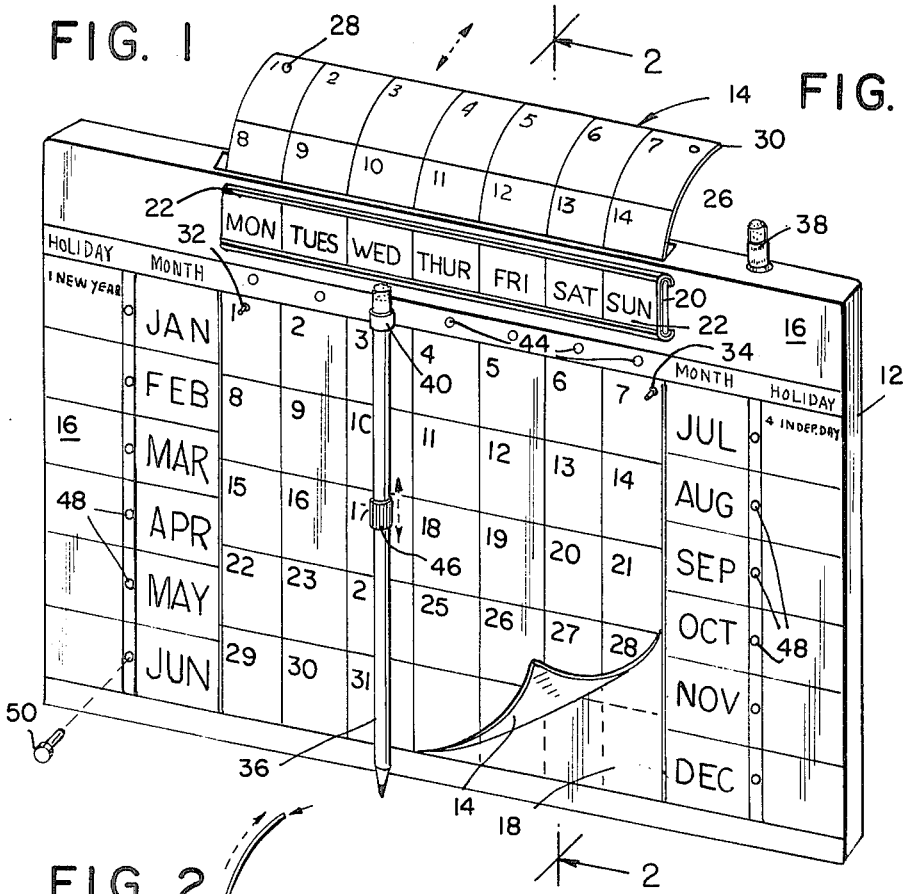
FIG. 3
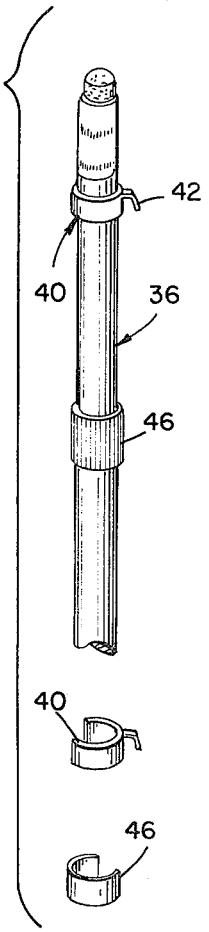
FIG. 2
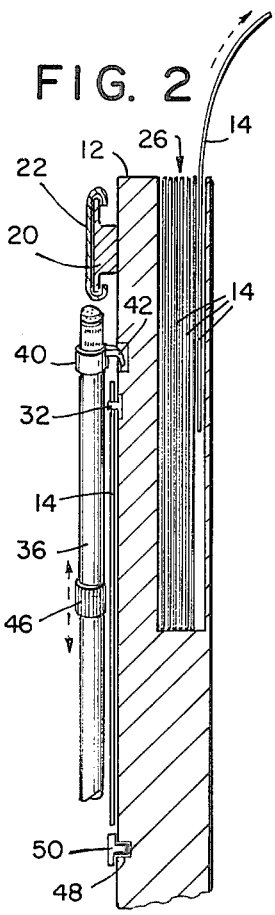
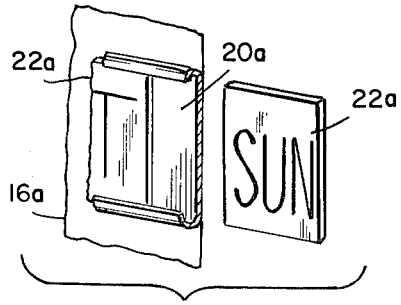
FIG. 5
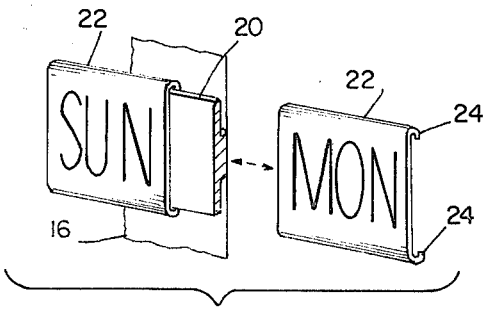
FIG. 4
FIG. 6
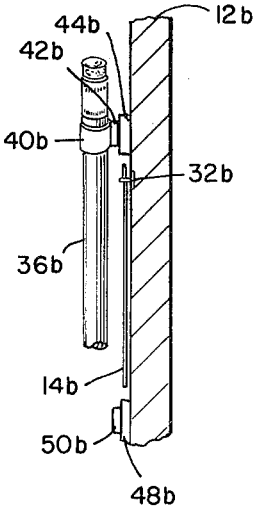

PERPETUAL CALENDAR

BACKGROUND OF THE INVENTION

1. Field of the Invention

This invention relates to a calendar and especially to a perpetual calendar embodied in a self-contained kit. The calendar kit further contains month, day and date indicants in addition to providing for memoranda recordation.

2. Description of the Prior Art

Calendar devices of the prior art include calendars which had slide indicators for denoting a specific monthly date such as shown in U.S. Pat. Nos. 782,842, 1,007,760, 1,685,692, 2,279,790 and 2,586,890. Those previously mentioned calendars were, however, not designed for perpetual use and therefore had to be replaced annually. In addition, they had no provision for diary entries, recording of information or visual scheduling displays.

The application of perpetual type calendars was described in U.S. Pat. Nos. 301,553, 3,827,168 and 4,015,351. A disadvantage of those calendar apparatus was that they were cumbersome to use, did not readily furnish a system for indicating events or recording notations keyed to particular dates and further were not designed for record keeping functions.

The improved calendar of this invention overcomes the shortcomings of the prior art by providing a perpetual calendar in kit form which includes a system for displaying and recording information in a monthly chronological array.

Another feature of the instant calendar kit is the incorporation of a writing instrument which is also functional as a day-date indicator.

SUMMARY OF THE INVENTION

Briefly, the nature of this invention concerns a calendar kit for perpetual monthly day-date reference. The purpose of this invention is to provide a new and convenient system for displaying the days, weeks and months of the year in a manner to facilitate visual scheduling of events, denoting data, recording information and to otherwise provide a written chronicle. The various entries can be made upon a grid sheet having divisions corresponding to the days of the month. The sheet can be placed in a supply/storage area integral with the board.

In compendium, the perpetual calendar kit of the present invention includes a display board for receiving monthly grid sheets, a positioning peg for noting the current month, and a plurality of tabs, each having indicia for representing a day of the week. The tabs are slidably mountable on the display board for orientation with respect to the grid sheets. A writing instrument is attachable to the board in overlying relationship with respect to the grid sheet in alignment with a particular day of the week. For this purpose, the instrument is provided with a collar engageable with an aperture in the display board for suspending the writing instrument at various positions corresponding to a particular weekday.

In an alternate embodiment, the writing instrument is magnetically attached to the display board. The writing instrument also has an adjustably displaceable date index.

It should thus be apparent that a salient feature of this invention concerns the incorporation of a writing instrument which can be readily removed from the display board to record data or other information on the monthly grid sheet.

A special characteristic of this invention is that the several components comprising the kit can be conveniently packaged in a compact self-contained format.

An important object of this invention relates to its ability to provide a monthly diary wherein previous chronicle entries upon the grid sheet may be retained for later reference.

Having thus summarized the invention, it will be seen that an object thereof is to provide a perpetual calendar kit of the general character described herein.

Specifically, it is an object of this invention to provide a perpetual calendar kit with tabs corresponding to the days of the week, which can be interchangeably arranged for alignment with respective dates on the monthly grid sheet.

It is a further object of this invention to provide a perpetual calendar kit incorporating a writing instrument which also provides a day-date index.

Another object of this invention is to provide a perpetual calendar kit which utilizes a plurality of grid sheets for providing a visual monthly schedule and for memoranda recordation.

It is a further object of this invention to provide a perpetual calendar kit having a removably placeable positioning peg for denoting the current calendar month.

An additional object of this invention is to provide a perpetual calendar kit containing a supply/storage compartment for the grid sheets.

Still another object of this invention is to provide a perpetual calendar kit which is relatively economical to manufacture and can readily be adapted for mass production fabrication techniques.

Other objects, features and advantages of this invention will be apparent and in part will be pointed out hereinafter.

With these ends in view, the invention finds embodiment in certain combinations of elements and arrangements of parts by which the objects aforementioned and certain other objects are hereinafter attained, all as more fully described with reference to the accompanying drawings and the scope of which is more fully pointed out and indicated in the appended claims.

DESCRIPTION OF THE DRAWINGS

In the accompanying drawings in which are shown the preferred embodiments of this invention:

FIG. 1 is a perspective view of a perpetual calendar kit of this invention and shows a display board, a grid sheet thereon, a plurality of tabs arranged in an appropriate sequence for referencing the days of the week as occurring in a current month, a positioning peg in exploded view for referencing a particular month, and a writing instrument having an adjustable date index for denoting a particular date;

FIG. 2 is a partial sectional view to a slightly enlarged scale taken substantially along line 2—2 of FIG. 1 and shows the writing instrument attached to the display board and a supply/storage compartment for the grid sheets with one grid sheet being partly withdrawn;

FIG. 3 is a partial perspective view to an enlarged scale and shows the writing instrument fitted with a support collar and an adjustable date index, as well as isolated views of the support collar and the date index removed from the writing instrument;

FIG. 4 is an isolated view in perspective to an enlarged scale showing two slidable tabs and a portion of a guide rail for mounting the tabs;

FIG. 5 is a partial perspective view of an alternate embodiment of a slidable panel and shows a channel track arrangement for accommodating the panel; and FIG. 6 is a partial sectional view corresponding substantially to the view shown in FIG. 2, however of an alternate embodiment of this invention wherein a writing instrument is provided with a magnetic support collar for securement to a display board.

DESCRIPTION OF THE PREFERRED EMBODIMENTS

Referring now in detail to the drawings, the reference numeral 10 denotes generally an exemplary embodiment of a perpetual calendar kit in accordance with this invention.

The calendar kit 10 as shown in FIG. 1 includes a display board 12 having a generally rectangular configuration accommodating a grid sheet 14 on a substantially planar display surface 16.

The display board 12 can be constructed from a cardboard blank with appropriate fold lines to form a hollow support structure which can be assembled by the purchaser. Alternatively, plastic, wood, laminate or equivalent materials can be utilized to form a rigid preformed unit.

The grid sheet 14 preferably is of a paper material, however it is contemplated that other like substances can be used for recording written indicia.

In the preferred embodiment the grid sheet 14 has a plurality of intersecting horizontal and vertical lines forming thirty-five uniform boxes which can be prenumbered sequentially from one to thirty-one reading from right to left and top to bottom. The remaining four boxes can be used for other notations.

The display surface 16 is preferably provided with a centrally located grid area 18 which can be formed into a pattern of spaces for indicating the days within a time frame, such as a month. The aforementioned grid markings can be of a permanent nature, and the surface 16 can be erasable. In this instance, the invention can be used without the replaceable grid sheets 14. A marginal portion of the display surface 16 is imprinted with selected indicia such as typically illustrated in FIG. 1 wherein the months of the year together with information pertinent thereto such as holidays or important events occurring within that corresponding month appear adjacent thereto for ready reference. Additional unprinted areas on the display surface 16 provide a medium on which advertising indicia can be affixed or imprinted.

The upper portion of the display surface 16 includes a guide rail 20 which is adapted to receive a slidable tab 22. Each of several tabs 22 is provided with indicia respective of a day of the week. The opposed sides of the tab 22 has a curved return 24 for engaging the guide rail 20. In a typical application, the tabs 22 are positioned in seriatim once a month in registration with the grid sheet 14. For example, FIG. 1 shows an arrangement for the month of June wherein the 1st day of the month is a Monday. If, for instance, the 1st day of the month is Wednesday, the tabs 22 can be slidably removed from one end of the guide rail 20 and inserted in the other end until the "WED" tab is aligned with the grid space marked "1".

A supply of monthly grid sheets 14 are provided within a storage compartment 26. The used sheets 14 can also be retained therein. The insertion and removal of a typical sheet 14 is indicated by the broken arrows in FIG. 1. In addition, each of the grid sheets 14 includes a pair of holes 28, 30 for mounting. The display board 12 has two projecting pins 32, 34 corresponding to the spacing of the grid sheet holes 28, 30 whereby the sheets 14 can be attached to the display surface 16 as in the manner shown by FIG. 1.

As previously mentioned, a feature of this invention includes the capabilities of providing a convenient and readily accessible visual schedule as well as including writing material for docketing information and memoranda. A writing instrument 36 such as a pencil or ball pen is thus incorporated. An additional or spare writing instrument 38 can suitably housed within an opening provided in the display board 12.

The writing instrument 36 is adapted to be suspended from the display board 12 in a manner which visually denotes a day and date of a month. For this purpose, a support collar 40 is provided with an integral flap or tag 42 and is resiliently secured to the writing instrument 36 at an uppermost position. The tag 42 is designed to be received in one of a plurality of horizontally spaced apertures 44, each corresponding to one of the several tabs 22, so as to vertically align the writing instrument 36 along the grid sheet 14 under a tab referenced day. An adjustable date index in the form of an annular band 46 is yieldably slidable along the writing instrument 36. The broken arrow notation shown in FIG. 1 indicates movement of the adjustable date index 46 in an axially upward or downward direction.

It should be apparent that the date index 46 can be positioned so as to be coincident with any selected dated grid space on the grid sheet 14.

If it is desired to make a notation within one of the dated spaces on the grid sheet 14, the instrument 36 can be readily removed for that purpose and afterward returned to its original position.

With regard to indication of the current month, a plurality of vertically spaced holes 48 are arranged on the display board 12 with each correspondingly located adjacent a different month indicated on the marginal portion of the display surface 16. A marker in the form of a positioning peg 50 is insertable in one of the holes 48 adjacent the current month.

A variant form of the slidable tab 22 is illustrated in FIG. 5. A panel **22*a* is shown having a substantially rectangular shape and includes indicia for indicating a specific day of the week. The panel 22*a* is slidable within a channel member 20*a*. In all other respects the use and operation of the panels 22*a*** are similar to those described for the tabs.

In a further modification, a writing instrument **36*b* is shown in FIG. 6. A support collar 40*b* incorporates a magnetic element 42*b* in place of the previously described tag 42. A corresponding metallic strip or magnetic section 44*b* of opposite polarity is annexed to a display board 12*b* in place of the apertures 48 to permit attachment of the writing instrument 36*b*. In a similar manner, a magnetic token 50*b* can be substituted for the peg 50 and is secured to the display board 12*b* by providing a magnetic segment 48*b***.

Thus, it should be apparent that there is provided a perpetual calendar kit which achieves the various objects of the invention and which is well adapted to meet the conditions of practical use. Since various possible embodiments of this invention might be made and since certain changes may be made in the above construction without departing from the spirit and scope of the invention, it is to be understood that all material contained in the above description or shown in the accompanying drawings shall be interpreted as illustrative and not in a limiting sense.

It is also to be understood that the following claims are intended to cover all of the generic and specific features of the invention herein described.

Having thus described the invention, there is claimed as new and desired to be secured by Letters Patent:

1. A perpetual calendar including a display board, grid means on the display board for indicating divisions within a monthly time frame, tab means having indicia representative of respective days in a week, said tab means being slidably mounted on the display board in sequential arrangement for alignment with selected related grid divisions corresponding to a day of the week, indicator means for cooperative interaction with the display board for denoting a particular month of the year, writing means including an elongated writing instrument, said writing instrument being removably attachable to the display board for recording information on the grid means, said writing instrument further including indexing means for referencing a particular day in the month, said indexing means being adjustably positionable relative to the writing instrument.

2. A perpetual calendar as claimed in claim 1 wherein the grid means includes a plurality of sheets, said grid sheets having an array of spaces corresponding to the days of the month and attachment means for removably securing a selected grid sheet to the display board.

3. A perpetual calendar as claimed in claim 2 wherein the array of spaces are consecutively numbered in consonance with the days in the month.

4. A perpetual calendar as claimed in claim 3 wherein the indexing means includes an annular band slidably positionable on the writing instrument.

5. A perpetual calendar as claimed in claim 1 further including collar means for removably attaching the writing instrument to the display board, said collar member having an integral tag, said display board including a plurality of apertures whereby the tag can be inserted in one of said apertures and the writing instrument suspended from the display board.

6. A perpetual calendar as claimed in claim 1 wherein the display board is provided with guide rail means for accommodating said tab means in interchangeable arrangement for registering the days of the month with a respective weekday.

7. A perpetual calendar as claimed in claim 1 wherein the writing instrument is magnetically attachable to the display board.

8. A perpetual calendar as claimed in claim 2 wherein the display board further includes a storage compartment for the supply and retention of grid sheets.

9. A perpetual calendar as claimed in claim 1 wherein the tab means includes independent panel elements and the display board is provided with a channel section for slidably receiving each panel element in interchangeable sequential arrangements.

10. A perpetual calendar as claimed in claim 2 wherein the writing instrument is suspended from the display board in an overlying portion with respect to the grid sheets.

* * * * *